US005154996A

United States Patent [19]

Makino et al.

[11] Patent Number: 5,154,996

[45] Date of Patent: Oct. 13, 1992

[54] ELECTROPHOTOGRAPHIC PHOTORECEPTOR WITH COPOLYMER BINDER OR INTERLAYER

[75] Inventors: Naonori Makino; Kenji Sano; Seiji Horie, all of Kanagawa, Japan

[73] Assignee: Fuji Photo Film Co., Ltd., Kanagawa, Japan

[21] Appl. No.: 456,623

[22] Filed: Dec. 29, 1989

Related U.S. Application Data

[63] Continuation-in-part of Ser. No. 311,782, Feb. 17, 1989, abandoned.

[30] Foreign Application Priority Data

Feb. 17, 1988 [JP] Japan ..... 63-34368
Apr. 11, 1988 [JP] Japan ..... 63-88374

[51] Int. Cl.[5] ..... G03G 5/047; G03G 5/14

[52] U.S. Cl. ..... 430/58; 430/60; 430/64; 430/96

[58] Field of Search ..... 430/57, 58, 60, 64, 430/96

[56] References Cited

U.S. PATENT DOCUMENTS

| | | | |
|---|---|---|---|
| 3,932,179 | 1/1976 | Perez-Albuerne | 430/64 |
| 4,082,551 | 4/1978 | Steklenski et al. | 430/64 |
| 4,427,754 | 1/1984 | Uchida et al. | 430/60 |
| 4,477,547 | 10/1984 | Yamada et al. | 430/58 X |
| 4,500,622 | 2/1985 | Horie | 430/58 X |
| 4,933,246 | 6/1990 | Teuscher | 430/64 |

FOREIGN PATENT DOCUMENTS

| | | | |
|---|---|---|---|
| 192040 | 11/1983 | Japan | 430/58 |

*Primary Examiner*—Roland Martin
*Attorney, Agent, or Firm*—Sughrue, Mion, Zinn, Macpeak & Seas

[57] ABSTRACT

An electrophotographic photoreceptor comprising an electro-conductive support having thereon at least one charge-generating layer and at least one charge-transporting layer, wherein said charge-generating layer contains, as a resin binder, a copolymer derived from at least one monomer represented by formula (I) and at least one monomer represented by formula (II) and a charge-generating substance, and wherein said charge-transporting layer is formed on said charge-generating layer by a coating solution containing a charge-transporting substance and a solvent not dissolving said resin binder:

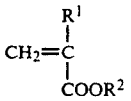
(I)

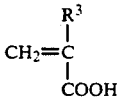
(II)

wherein $R^1$ and $R^3$, which may be the same or different, each represents a hydrogen atom or a methyl group; and $R^2$ represents an unsubtituted or substituted alkyl group or an unsubstituted or substituted aralkyl group. Because of incorporation of the particular copolymer, the photoreceptor has high sensitivity, little fluctuation of electrophotographic characteristic in repeated use, excellent capacity of forming uniform images, excellent charging property and small residual potential. Specifically, the charge-generating layer is not dissolved out in formation of the charge-transporting layer over the charge-generating layer.

15 Claims, No Drawings

ELECTROPHOTOGRAPHIC PHOTORECEPTOR WITH COPOLYMER BINDER OR INTERLAYER

This is a continuation-in-part of Applic. No. 07/311,782 filed Feb. 17, 1989 now abandoned.

FIELD OF THE INVENTION

The present invention relates to an electrophotographic photoreceptor, in particular, it relates to an electrophotographic photoreceptor which is composed of a combination of a photoconductive material and a specific resin binder and which has improved electrophotographic characteristic, image uniformity and durability.

BACKGROUND OF THE INVENTION

Hitherto, inorganic photoconductive materials such as selenium, cadmium sulfide, zinc oxide or amorphous silicon have been used as electrophotographic photoconductive materials. The inorganic photoconductive materials advantageously have good electrophotographic characteristics which include good photoconductivity, charge-acceptability in the dark and insulating property. On the other hand, however, they have various disadvantage. For instance, the manufacture cost is high, they often cause environmental pollution, they lack flexibility and they are not sufficiently resistant to heat and mechanical shock.

Recently, in order to overcome the drawbacks of the inorganic photoconductive materials, electrophotographic photoreceptors made of organic photoconductive materials have widely been studied and various kinds of such photoreceptors have been proposed.

In organic electrophotographic photoreceptors of the kind, the leading style is a laminate type photoreceptor having two layers of a charge-generating layer which generates a charge carrier by exposure and a charge-transporting layer which transports the charge carrier generated.

The charge-generating layer is basically composed of a charge-generating substance which absorbs light to generate a charge carrier and a resin binder. The charge-generating substance is required to be uniformly dispersed in the layer. Non-uniform dispersion of the substance would often cause defects of white spots or black spots on the image formed. Therefore, selection of the binder is important. In addition, in electrophotographic process, high photosensitivity and small potential fluctuation in repeated use are required, and the charge carrier as generated in the charge-generating layer must be introduced efficiently into the charge-transporting layer. The resin binder for dispersing the charge-generating substance therein has an extremely large influence on the mobility of the charge carrier generated, with respect to the chemical structure, molecular weight and purity of the resin binder itself.

In the photoreceptor of such a type that the charge-generating layer is first formed on an electro conductive support and then the charge-transporting layer is formed over the charge-generating layer, when the resin binder in the charge-generating layer is soluble in the coating solvent for the charge-transporting layer, the previously formed charge-generating layer would be dissolved out during formation of the charge-transporting layer to cause intermixture in the interlayer between the charge-generating layer and the charge-transporting layer. As a result, the sensitivity is lowered, the residual potential is elevated and the electrophotgraphic characteristics are lowered. Such are troublesome problems. In addition, the image to be obtained also has problematic drawbacks of white spots, fog and image blur.

As the resin binder to be used in the charge-generating layer, polyester resins are used in combination with azo dyes (JP-A-54-22834). (The term "JP-A" as used herein means an "unexamined published Japanese patent application.) Further, use of hydropropyl cellulose resins (JP-A-57-169754), fatty acid cellulose ester resins (JP-A-58-166353), acrylic resins (JP-A-58-192040), polyvinyl butyral resins in combination with polyamide-subbing layer (JP-A-58-30757), linear polyester resins in combination with copolymerized polyamide-subbing layer (JP-A-58-93739), or phenoxy resins, polyvinyl formal resins or ethyl cellulose resins in combintion with alcohol-soluble nylon-subbing layer (JP-A-60-196766, JP-A-60-202448, and JP-A-60-202449) has heretofore been reported.

However, even when the said resin binders are used in the charge-generating layer, the sensitivity, image uniformity and solvent-resistance are still insufficient. Under the situation, further improvement of the resin binders for the charge-generating layer are being desired.

On the other hand, various measures have been effected so as to impart high charging property, high sensitivity and low residual potential to the laminate-type photoreceptor. As one of such measures, it is known to provide a subbing layer between the electroconductive support and the photosensitive layer so as to prevent introduction of the electric charge from the electroconductive support to the photo-sensitive layer.

In addition, defects, stains or scratches, if any, on the surface of the electroconductive support would cause drawbacks of coating failure, spots or unevenness in formation of the photo-sensitive layer, which would thereby result in formation of non-uniform image with white spots, black spots and fog. In order to overcome such non-uniform image, it is also known to be effective to provide the subbing layer.

As the resins to be used for the subbing layer, nitrocellulose resins (JP-A-48-3544), polyvinyl butyral resins (JP-A-50-28837 and JP-A-59-36258), polyvinyl alcohol resins (JP-A-52-100240), alcohol-soluble nylon resins (JP-A-52-25638), polyvinyl formal resins (JP-A-57-90639), water-soluble polyvinyl butyral resins (JP-A-58-106549}, blend of polyvinyl butyral resin and phenol resin (JP-A-59-36259), as well as resins of polyvinyl methyl ether, polyvinyl imidazole, polyethyleneoxide, polyurethane, polyamide, melamine, polyvinyl pyrrolidone, cellulose ester, casein and gelatin are known.

Further, it is also known to add electron donating substances, charge-accepting substances, fine grains of metal oxides or quaternary ammonium salt compounds to the subbing layer to control the electric resistance of the layer so as to improve the electrophotographic characteristics of the photoreceptor (JP-A60-140357, JP-A-59-170846 and JP-A-59-84257).

However, in the photoreceptor of the type having such subbing layer, the film thickness of the subbing layer is required to be made thick so as to enrich the charging property of the photoreceptor, but the thick subbing layer film causes a problem of increasing the residual potential after exposure. In addition, the subbing layer is often affected by the influence of water in air, so that the photoreceptor having such subbing layer is to have high electric charge and high residual potential under the condition of low temperature and low humidity but to have low electric charge and low residual potential under the condition of high temperature and high humidity. Thus the photoreceptor of the kind has a troublesome problem that the electrophotographic characteristic fluctuates in accordance with the ambient circumstance.

Moreover, the photoreceptor having a subbing layer has another problem that the residual potential increases in repeated use to give background fog in the image formed.

SUMMARY OF THE INVENTION

A first object of the present invention is to provide an electrophotographic photoreceptor with high sensitivity and whith little fluctuation of electrophotographic characteristic in repeated use.

A second object of the present invention is to provide an electrophotographic photoreceptor having an excellent capacity of forming uniform images (image uniformity).

A third object of the present invention is to provide an electrophotographic photoreceptor having excellent electrophotographic characteristic and image uniformity (especially, having neither white spots in the image area nor fog (stains) in the non-image area), in which the charge-generating layer has not been dissolved out in formation of the charge-transporting layer over the charge-generating layer.

A further object of the present invention is to provide an electrophotographic photoreceptor having excellent charging property, high sensitivity and small residual potehtial in which fluctuation of electrophotographic characteristic is little in repeated use and to provide such photoreceptor having an excellent image uniformity.

In order to attain the said objects, there is provided in accordance with the present invention an electrophotographic photoreceptor having at least one charge-generating layer and at least one charge-transporting layer as formed on an electroconductive support, which is characterized in that the photoreceptor contains the charge-generating layer containing a charge-generating substance and a copolymer derived from at least one monomer of the following formula (I) and at least one monomer of the following formula (II) and the charge-transporting layer which is formed by coating a coating solution containing a charge-transporting substance and a solvent not dissolving the copolymer.

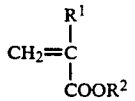

(I)

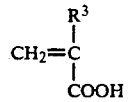

(II)

wherein $R^1$ and $R^3$, which may be the same or different, each represents a hydrogen atom or a methyl group; $R^2$ represents an alkyl group or an aralkyl group, which may optionally be substituted by substituent(s).

Another embodiment, there is also provided in accordance with the present invention an electrophotographic photoreceptor having a photo-sensitive layer on an electroconductive support, which is characterized by having a subbing layer containing a copolymer derived from at least one monomer of the formula (I) and at least one monomer of the formula (II) between the electroconductive support and the photo-sensitive layer.

DETAILED DESCRIPTION OF THE INVENTION

In the formula (I), $R^2$ preferably represents an alkyl group having from 1 to 18 carbon atoms, such as methyl, ethyl, propyl, butyl or cyclohexyl group, or an aralkyl group having from 7 to 12 carbon atoms, such as benzyl, phenethyl or 3-phenylpropyl group.

When $R^2$ represents a substituted alkyl group, examples of the substituents include a halogen atom (e.g., fluorine, chlorine, or bromine), a trifluoromethyl group, a nitro group, an amino group, a dialkylamino group (e.g., diethylamino), a carboxyl group, a sulfonic acid group, an alkoxy group (e.g., methoxy, ethoxy) and a cyano group.

When $R^2$ represents a substituted aralkyl group, examples of the substituents on the aryl moiety include the same groups as mentioned for the substituents for the aforesaid substituted alkyl group and additionally a lower alkyl group having from 1 to 6 carbon atoms.

The position and the number of the substituents may be freely selected.

In addition to the monomers of the formulae (I) and (II), any other monomers may be used together with them. As examples of such additional monomers, ethylenic double bond-containing compounds may be mentioned, which include, for example, styrene compounds (e.g., styrene, vinyltoluene), vinyl ether compounds (e.g., methyl vinyl ether, ethyl vinyl ether), vinyl acetate, crotonic acid, maleic acid compounds (e.g., maleic anhydride, dichloromaleic acid), ethylene, butadiene, acylonitrile, vinylidene chloride and other vinyl compounds (e.g., N-vinylcarbazole, vinylnaphthalene, vinylanthracene, N-vinylpyrrolidone).

These monomers except the monomers of the formulae (I) and (II) can be used in combination of two or more of them.

Of the monomers of the formula (I), benzyl methacrylate is particularly preferred.

Of the monomers of the formula (II), methacrylic acid is particulary preferred.

The copolymerization ratio (molar ratio) of the monomer of the formula (I) to the monomer of the formula (II) is preferably 20/1 to 1/20, particulary preferably 0/1 to 1/1.

When other monomers than the monomers of the formulae (I) and (II) are additionally used, the proportion of the additional monomers is 60 mol% or less, preferably from 10 to 60 mol%, of the total polymer.

The polymer preferably has a molecular weight of from 1,000 to 300,000, particularly preferably from 10,000 to 150,000.

The resin binder for use in the present invention is soluble, for example, in an ether sovent (e.g., tetrahydrofuran, dioxane, dimethyoxyethane, 1-acetoxy-2-methoxyethane, 1,2-propylene glycol-1-methyl ether, 1,2-propylene glycol-1-methyl ether-2-acetate) and a ketone solvent (e.g., acetone, methylethylketone, cyclohexane). On the other hand, the resin binder for use in the present invention is insoluble or sparingly-soluble, for example, in a halogenated hydrocarbon solvent (e.g., dichloromethane, chloroform, dichloroethane, trichloroethane, trichloroethylen), an aromatic solvent (e.g., benzene, toluene, xylene, chlorobenzene), an ester solvent (e.g., ethyl acetate, n-butyl acetate) and an alcohol solent (e.g., methanol, ethanol).

In addition, the resin binder for use in a present invention is excellent in dispersibility of a charge-generating substance.

The resin binder for use in the present invention is disclosed in U.S. Pat. No. 4,500,622 as a binder for the light-sensitive layer of an electrophotographic printing plate precursor. But the light-sensitive layer in U.S. Pat. No. 4,500,622 is a single layer and its sensitivity is insufficient.

The present invention is to improve the sensitivity by separating a charge-generating layer and a charge-transporting layer. In addition, incorporation of the resin binder of the present invention into the charge-generating layer can prevent elution of the charge-generating layer when the charge-transporting layer is formed. As a result, the excellent electrophotographic properties and image uniformity can be obtained.

U.S. Pat. No. 4,500,622 discloses a subbing layer may be coated. But the excellenet electrophotographic properties and image uniformity can also be obtained using the resin binder of the present invention as a subbing layer.

The resin binder for use in the present invention can be prepared by copolymerizing monomers selected from the monomer groups of the formulae (I) and (II) in a desired proportion. For copolymerization of the monomers, known methods may be employed, which include, for example, solution polymerization, suspension polymerization, precipitation polymerization and emulsion polymerization. Specifically, in solution polymerization, the monomers are blended in a determined ratio in a solvent such as benzene or toluene, and a radical polymerization initiator such as azobisisobutyronitrile, benzoyl peroxide or lauryl peroxide is added thereto to initiate polymerization to obtain a desired copolymer solution. The resulting copolymer solution may be dried or added to a bad solvent to obtain the desired copolymer. On the other hand, in suspension polymerization, monomers are suspended in a medium in the presence of a dispersing agent such as polyvinyl alcohol or polyvinyl pyrrolidone and are copolymerized in the presence of a radical polymerization initiator to obtain the intended copolymer. In such copolymerization methods, a chaintransferring agent such as lauryl mercaptane or the like mercaptane compound can be used for the purpose of adjusting the molecular weight of the copolymers formed.

As the charge-generating substance for the present invention, inorganic photoconductive materials such as selenium, selenium-tellurium, cadmium sulfide or zinc oxide, as well as organic photoconductive materials of the following (1) to (9) can be used.

(1) Monoazo, bisazo, trisazo pigments described in U.S. Pat. Nos. 4,436,800 and 4,439,506, JP-A-47-37543, JP-A-58-123541, JP-A-58-192042, JP-A-58-219263, JP-A-59-78356, JP-A-60-17946, JP-A-61-148453 and JP-A-61-238063, and JP-B-60-5941 and JP-B-60-45664. (The term "JP-B" as used here:n means an "examined Japanese patent publication".)

(2) Phthalocyanine pigments such as metal phthalocyanines or metal-free phthalocyanines, described in U.S. Pat. Nos. 3,397,086 and 4,666,802.

(3) Perylene pigments described in U.S. Pat. No. 3,371,884.

(4) Indigo and thioindigo derivatives described in British Patent 2,237,680.

(5) Quinacridone pigments described in British Patent 2,237,679.

(6) Polycyclic quinone pigments described in British Patent 2,237,678 and JP-A-59-184348 and JP-A-6228738.

(7) Bisbenzimidazole pigments described in JP-A-47-30331.

(8) Squalium salt pigments described in U.S. Pat. Nos. 4,396,610 and 4,644,082.

(9) Azulenium salt pigments described in JP-A-59-53850 and JP-A-61-212542.

These organic photoconductive materials may be used in combination of two or more of them.

Of the said charge-generating substances, azo pigments are preferred.

The formation of the charge-generating layer, the charge-generating substance is dispersed in a solvent singly or together with a binder.

The charge-transporting layer of the present invention is basically composed of a charge-transporting substance which transports the charger carrier as generated in the charge-generating layer and a resin binder. When the charge-transporting substance is a high molecular compound, the charge-transporting layer may be composed of a simple body.

Charge carrier-transporting compounds are generally grouped into two groups, electron-transporting compound and positive hole-transporting compounds. Both of the two groups may be used in the electrophotographic photoreceptor of the present invention.

The electron-transporting compounds are electron-attracting group-containing compounds, which include, for example, 2,4,7-trinitro-9-fluorenone, 2,4,5,7-tetranitro-9-fluorenone, 9-dicyanomethylene-2,4,7-trinitrofluoroenone, 9-dicyanomethylene-2,4,5,7-tetranitrofluorenone, tetranitrofluorenone, tetranitrocarbazole, chloranyl, 2,3-dichloro-5,6-dicyanobenzoquinone, 2,4,7-trinitro-9,10-phenanthrenequinone, tetrachlorophthalic anhydride, tetracyanoethylene and tetracyanoquinodimethane.

The positive hole-transporting compounds are electron-donating group-containing compounds, and examples of the compounds are mentioned below.

High Molecular Compounds (a) Polyvinyl carbazole and derivatives thereof, described in JP-B-34-10966.

(b) Vinyl polymers, such as polyvinyl pyrene, polyvinyl anthracene, poly-2-vinyl-(4,4'-dimethylaminophenyl)-5-phenyloxazole or poly-3-vinyl-N-ethylcarbazole, described in JP-B-43-18674 and JP-B-43-19192.

(c) Polymers such as polyacenaphthylene, polyindene or acenaphthylene/styrene copolymer, described in JP-B-43-19193.

(d) Condensed resins, such as pyrene/formaldehyde resin, bromopyrene/formaldehyde resin or ethylcarbazole/formaldehyde resin, described in JP-B-56-13940.

(e) Various triphenylmethane polymers described in JP-A-56-90883 and JP-A-56-161550.

Low Molecular Compounds (f) Triazole derivatives described in U.S. Pat. No. 3,112,197.

(g) Oxadiazole derivatives described in U.S. Pat. No. 3,189,447.

(h) Imidazole derivatives described in JP-B-37-16096.

(i) Polyarylalkane derivatives described in U.S. Pat. Nos. 3,615,402, 3,820,989 and 3,542,544, JP-B-45-555 and JP-B-51-10983 and JP-A-51-93224, JP-A-55-108667, JP A-55-156953 and JP-A-56-36656.

(i) Pyrazoline derivatives and pyrazolone derivatives described in U.S. Pat. Nos. 3,180,729 and 4,278,746, and JP-A-55-88064, JP-A-55-88065, JP-A-49-105537, JP-A-55-51086, JP-A-56A-80051, JP-A-pb 56-88141, JP-A-57-45545, JP-A-54-112637 and JP-A-55-74546.

(k) Phenylenediamine derivatives described in U.S Pat. Nos. 3,615,404, JP-B-51-10105, JP-B-46-3712 and JP-B-47-28336, and JP-A-54-83435, JP-A-54-110836 and JPA-54-119925.

(l) Arylamine derivatives described in U.S. Pat. Nos. 3,567,450, 3,180,703, 3,240,597, 3,658,520, 4,232,103, 4,175,961 and 4,012,376, West German Patent (DAS) 1,110,518, JP-B-49-35702 and JB-39-27577 and JP-A-55-144250, JP-A-56-119132 and JP-A-56-22437.

(m) Amino-substituted chalcone derivatives described in U.S. Pat. No. 3,526,501.

(n) N,N-vicarbazyl derivatives described in U.S. Pat. No. 3,542,546.

(o) Oxazole derivatives described in U.S. Pat. No. 3,257,203.

(p) Styrylanthracene derivatives described in JP-A-56-46234.

(q) Fluorenone derivatives described in JP-A-54-110837.

(r) Hydrazone derivatives described in U.S. Pat. No. 3,717,462, JP-A-54-59143 (corresponding to U.S. Pat. No. 4,150,987), JP-A-55-52063, JP-A-55-52064, JP-A-55-46760, JP-A-55-85495, JP-A-57-11350, JP-A57-148749 and JP-A-57-104144.

(s) Benzidine derivatives described in U.S. Pat. Nos. 4,047,948, 4,047,949, 4,265,990, 4,273,846, 4,299,897 and 4,306,008.

(t) Stilbene derivatives described in JP-A-58-190953, JP-A-59-95540, JP-A-59-97148, JP-A-59-195658 and JP-A-62-36674.

The charge carrier-transporting compounds for use in the present invention are not limited to only the above-mentioned compounds (a) to (t) but any other known charge carrier-transporting compounds may of course be used in the present invention.

Two or more kinds of the said carrier-transporting compounds can be used together, if desired.

When the charge carrier-transporting compounds for use in the present invention is low molecular compounds, these are preferred to be used together with a binder.

As the binder to be used in the charge-generating layer and charge-transporting layer, electric-insulating and film-forming high molecular polymers which are hydrophobic and which have a high dielectric constant are preferred. Examples of high molecular polymers of the kind are mentioned below, which, of course, are not limitative.

Polycarbonate, polyester, polyester carbonate, polysulfone, methacrylic resin, acrylic resin, polyvinyl chloride, polyvinylidene chloride, polystyrene, polyvinyl acetate, styrene-butadiene copolymer, vinylidene chloride-acrylonitrile copolymer, vinyl chloride-vinyl acetate copolymer, vinyl chloride-vinyl acetate-maleic anhydride copolymer silicone resin, silicone-alkyd resin, phenol-formaldehyde resin, styrene-alkyd resin, styrene-maleic anhydride copolymer, phenoxy resin, polyvinyl butyral resin, poly-N-vinylcarbazole.

These resin binders may be used singly or in the form of a mixture of two or more of them.

The resin binder may also be incorporated into the charge-generating layer in the form of a mixture with the aforesaid copolymer of the invention.

As preferred embodiments of the layer constitution of the photoreceptor of the present invention, which has a subbing layer and a photo-sensitive layer as formed on an electroconductive support, the following layer constitutions (A) to (C) are mentioned.

(A) Subbing layer, charge-generating layer and charge-transporting layer are laminated on electroconductive support in the order.

(B) Subbing layer, charge-transporting layer and charge-generating layer are laminated on electroconductive support in the order.

(C) Subbing layer and layer having a chargegenerating substance only or both a charge-generating substance and a charge-transporting substance as uniformly dispersed or dissolved therein are formed on electroconductive support.

In a case where a subbing layer is not coated, layer constitutions (D), (E), and (F), in which a subbing layer is omitted in the said layer constitutions (A), (B), and (C), respectively, are mentioned.

In the said layer constitutions (A) to (F), a surface-protecting layer may be formed on the photosensitive layer.

Further, an interlayer may also be formed between the charge-genelating layer and the charge-transporting layer, in the said layer constitutions (A) to (F).

The electroconductive support for use in the electrophotographic photoreceptor of the present invention may be a metal plate or drum made of aluminium, copper, zinc or stainless steel, a plastic sheet or film (e.g., polyester sheet or film) as coated with an electroconductive material (e.g., aluminium, indium oxide, tin oxide or copper iodide) by vacuum evaporation-plating or dipersion-coating, or a paper as processed to have electroconductivity.

In accordance with the present invention, the subbing layer is formed by coating a solution of a polymer as dissolved in a solvent on the electroconductive support. As the solvent usable for the purpose, there are tetrahydrofuran, dioxane, methyl cellosolve, acetone, cyclohexanone, methyl ethyl ketone, methyl isobutyl ketone, methoxypropanol and methoxypropanol acetate. For coating the solution, various means of dipping method, wire bar coating method, blade coating method, spraying method, extrusion method, applicator coating method or hopper coating method can be employed.

The thickness of the subbing layer is preferably from 0.01 to 10 μm, particularly preferably from 0.01 to 2 μm.

In the electrophotographic photoreceptor of the present invention, the subbing layer may be made of only the polymer of the invention or may also be made of the polymer of the invention and any other components. In the latter case, polymers which are generally used for formation of electrophotographic photoreceptors can be combined with the polymer of the invention for forming the subbing layer, whereupon the proportion of the polymer of the invention is preferably 1% by weight or more, particularly preferably 20% by weight or more.

In a case where the polymer of the present invention is contained in a charge-generating layer, it is not necessarily to use a subbing layer and, as a subbing layer, it may be used the polymer of the present invention and the polymer which is usually used in a conventional electrophotographic photoreceptor.

The subbing layer may be further treated, for the purpose of improving the adhesiveness and the mechanical strength thereof, by a method of hardening the layer together with a hardening agent such as isocyanate compounds or epoxy compound, a method of surface-treating the electroconductive support with a silane-coupling agent or a titanium-coupling agent, or a method of incorporating such coupling agent into the subbing layer.

In addition, the subbing layer may further contain fine grains of metals or metal oxides, quaternary ammonium salt compounds, as well as charge-generating substances or charge-transporting substances in a minor amount.

As the coating solvent for the charge-generating layer, it is preferred to use a solvent which is soluble to the resin binder of the present invention, such as an ether solvent (e.g., tetrahydrofuran, dixoane, dimethoxyethane, 1-acetoxy-2-methoxyethane, 1,2-propylene glycol1-methyl ether, 1,2-propylene glycol-1-methyl ether 2-acetate) and a ketone solvent (e.g., acetone, methylethylketone, cyclohexanone).

For regulating the dry speed, a mixed solvent mainly composed of the above-noted soluble solvent may be used within a range that the resin binder of the present invention is soluble.

As the coating solvent for the charge-transporting layer, it is preferred to use a solvent which is insuluble to the resin of the present invention, such as a halogenated hydrocarbon solvent (e.g., dichloromethane, chloroform, dichloroethane, trichloroethane, trichloroethylen) and an aromatic solvent (e.g., benzene, toluene, xylene, chlorobenzene, dichlorobenzene).

For regulating the dry speed, a mixed solvent mainly composed of the above-noted insoluble solvent may be used within a range that the resin binder of the present invention is insoluble.

In formation of the electrophotographic photoreceptor of the present invention, additives such as plasticizer or sensitizer may be added to the charge-generating layer and the charge-transporting layer. In addition, a charge-transporting compound may be added to the charge-generating layer.

As the plasticizer to be used for the purpose, there are biphenyl, biphenyl chloride, o-terphenyl, p-terphenyl, dibutyl phthalate, dimethylglycol phthalate, dioctyl phthalate, triphenyl phosphate, chlorinated paraffin and dilaurylthio dipropionate.

In order to improve the surface property of the electrophotographic photoreceptor of the invention, silicone oil or fluorine surfactants may be used.

As the sensitizer which may be used in the photoreceptor of the invention, there are chloranly, tetracyanoethylene, methyl violet, rhodamine B, cyanine dyes, merocyanine dyes, pyrylium dyes and thiapyrylium dyes.

The charge-generating layer may be formed by a vacuum evaporation plating method or the same method as that of forming the aforesaid subbing layer. The charge-transporting layer can be formed by the same method as that of forming the subbing layer.

The electrophotographic photoreceptor of the present invention can be prepared by coting and drying a dispersion of fine grains of a charge-generating substance as dispersed in a binder-containing solvent on an electroconductive support and then further coating and drying a solution containing a charge-transporting substance and a binder on the thus formed charge-generating layer. Alternatively, the charge-transporting layer and the charge-generating layer may be coated in this order to prepare the electrophoto-graphic photoreceptor of the invention.

The thickness of the charge-generating layer is 0.01 to 4 μm, preferably 0.1 to 2 μm; and that of the charge-transporting layer is from 3 to 30 μm, preferably from 10 to 20 μm.

The charge-generating substance is preferably milled with a milling machine such as ball mill, sand mill or shaking mill, to have a grain size of 5 μm or less, preferably 1 μm or less.

In the electrophotographic photoreceptor of the generating substance to the resin binder in the charge-generating substance to the resin binder in the charge-generating layer is preferably 20/1 to 1/10, particularly preferably 5/1 to 1/3. The weight ratio of the charge-transporting substance to the resin binder in the charge-transporting layer is preferably 5/1 to 1/5, particularly preferably 2/1 to 1/2.

When high molecular charge-transporting substances which can be used as a binder by themselves are used, any further additional resin binder may be omitted.

When the photo-sensitive layer is made of one layer, as in the aforesaid constitution (C), the charge-generating substance and the charge-transporting substance may be uniformly blended to form one photosensitive layer.

As is obvious from the explanation as above, the electrophotographic photoreceptor of the present invention have various excellent advantages that the charging property is good, the sensitivity is high, the residual potential is low, the fluctuation of electrophotographic characteristics in repeated use is small and the image uniformity is excellent.

The electrophotographic photoreceptor of the present invention can widely be applied to the field of electrophotographic copying machines and photoreceptors of printers using laser, Braun tube or LED as a light source.

The following examples are intended to illustrate the present invention in greater detail but not to limit it in any way. Unless otherwise specifically indicated, "part" means "part by weight".

EXAMPLE 1 AND COMPARATIVE EXAMPLES 1 AND 2

2 parts of the triazo pigment having the following structural formula (III) and 2 parts of benzyl methacrylate/methacrylic acid copolymer of the invention (molecular weight 100,000; limiting viscosity [η] in methyl ethyl ketone at 30° C, 0.12; methacrylic acid content 30 mol%) were added to 7 parts of tetrahydrofuran and dispersed in a ball mill for 12 hours. Then the resulting dispersion was coated on an electroconductive support (having aluminium-plated film on a 75 μm polyethylene terephthalte support) and dried to form a charge-generating layer having a thickness of about 0.5 μm on the support.

Next, a solution formed by dissolving 3.6 parts of p-(diphenylamino)benzaldehyde-N'-methyl-N'-phenylhydrazone having the following structural formula (IV) and 4 parts of polycarbonate of bisphenol A (Panlite K-1300, trade name by TEIJIN LTD.) in a solution comprising 13.3 parts of dichloromethane and 26.6 parts of dichloroethane was coated over the said charge-generating layer with an applicator to form a charge-transporting layer having a thickness of 17 μm thereon. Thus an electrophotographic photoreceptor having a photosensitive layer composed of two layers was formed.

lamp whereupon the illuminance on the surface of the photoreceptor was 3 lux, and the exposure amount (E50) required for attenuating the surface potential to the half of the initial surface potential ($V_0$) and the surface potential (residual potential V) in 30 seconds after exposure were determined. The determination was (III)

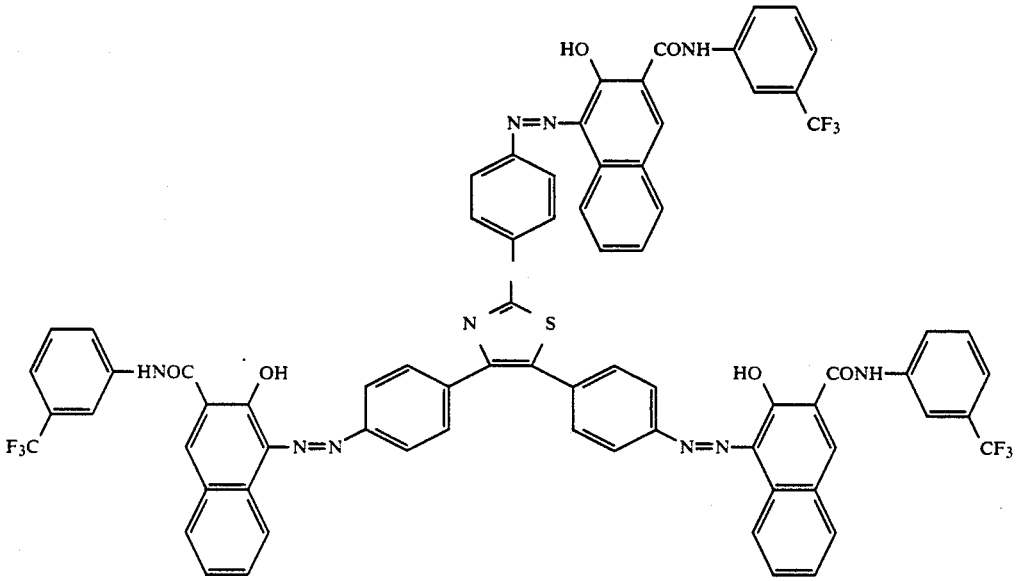

(IV)

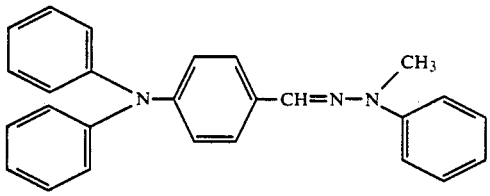

repeated 3000 times. The results obtained are shown in Table 1 below.

For comparison, a polyester resin (trade name, Adhesive 49000, by E. I. Du Pont de Nemours & Co.) or a polyvinyl butyral resin (trade name, XYHL, by Union Carbide) was used as the resin binder for the charge-generating layer, in place of the benzyl methacrylate/-methacrylic acid copolymer, to prepare comparative photoreceptors (Comparative Example 1, Comparative Example 2).

TABLE 1

| | 1st Measurement | | | | 3000th Measurement | | | |
|---|---|---|---|---|---|---|---|---|
| | $E_{50}$ (lux · sec) | $V_S$ (V) | $V_O$ (V) | $V_R$ (V) | $E_{50}$ (lux · sec) | $V_S$ (V) | $V_O$ (V) | $V_R$ (V) |
| Example 1 | 1.6 | −980 | −780 | −1 | 1.6 | −970 | −760 | −2 |
| Comparative Example 1 | 2.2 | −960 | −730 | −10 | 2.7 | −950 | −720 | −210 |
| Comparative Example 2 | 2.3 | −980 | −750 | −5 | 3.1 | −750 | −620 | −30 |

The electrophotographic characteristic of each of the thus prepared photoreceptors was evaluated, using an electrostatic copying paper test apparatus (SP-428 Type, manufactured by Kawaguchi Electric Manufacturing Co.). The measurement was effected in accordance with the static system. Precisely, the photoreceptor to be tested was charged by corona discharge (−6 KV) and the initial surface potential ($V_s$) was determined. Then this was allowed to stand in the dark for 30 seconds, and the surface potential ($V_R$) was determined. Next, the photoreceptor was exposed to a tungsten The results in Table 1 apparently demonstrate that the photoreceptor of Example 1 (where the resin binder of the invention was used in the charge-generating layer) was superior to the other comparative photoreceptors as the sensitivity was extremely high and the fluctuation of the electrophotographic characteristic in repeated use was extremely small. This is because the charge-generating layer did not dissolve out in formation of the charge transporting layer in Example 1.

Each of the photoreceptors was attached to a 84 mmϕ aluminium drum and set in a copying machine (trade name FX-2770, manufactured by Fuji Xerox Co., Ltd.). The machine was driven and the copied images were evaluated in every case. As a result, the photoreceptor of Example 1 gave sharp and uniform images, while the photoreceptors of Comparative Examples 1 and 2 gave bad images having noticeable white spots in the black image area and noticeable fogs in the white background area.

EXAMPLES 2 to 9

Two-layer structural electrophotographic photoreceptors were prepared in the same manner as in Example 1, except that the polymers as indicated in Table 2. below were used as the resin binder for the charge-generating layer. Then the values of $E_{50}$, $V_s$, $V_0$ and $V_R$ of each of the thus prepared photoreceptors were also determined in the same. manner as in Example 1. The results obtained are shown in Table 3 below.

TABLE 2

| Example No. | Polymer Used (molecular weight) |
|---|---|
| 2 | 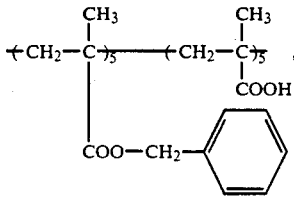 , (150,000) |
| 3 | 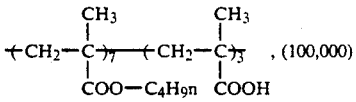 , (100,000) |
| 4 | 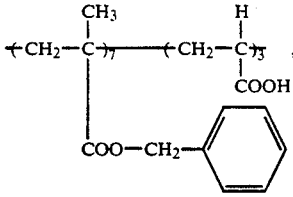 , (100,000) |
| 5 | 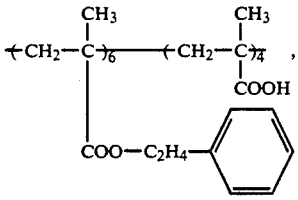 , (120,000) |
| 6 | 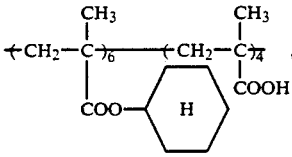 , (90,000) |

TABLE 2-continued

| Example No. | Polymer Used (molecular weight) |
|---|---|
| 7 | 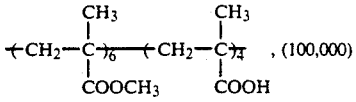 , (100,000) |
| 8 | 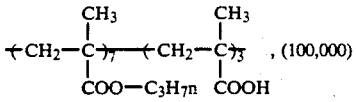 , (100,000) |
| 9 | 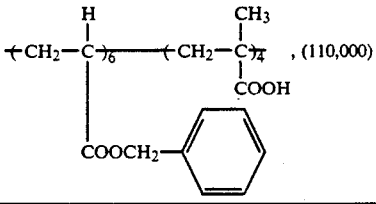 , (110,000) |

TABLE 3

| Example No. | 1st Measurement $E_{50}$ (lux · sec) | $V_S$ (V) | $V_O$ (V) | $V_R$ (V) | 3000th Measurement $E_{50}$ (lux · sec) | $V_S$ (V) | $V_O$ (V) | $V_R$ (V) |
|---|---|---|---|---|---|---|---|---|
| 2 | 1.6 | −950 | −730 | 0 | 1.6 | −930 | −715 | −1 |
| 3 | 1.7 | −930 | −750 | −2 | 1.8 | −930 | −740 | −4 |
| 4 | 1.6 | −900 | −740 | −1 | 1.6 | −900 | −730 | −3 |
| 5 | 1.7 | −980 | −750 | −1 | 1.7 | −930 | −750 | −2 |
| 6 | 1.7 | −890 | −720 | 0 | 1.7 | −880 | −705 | −3 |
| 7 | 1.6 | −920 | −750 | 0 | 1.7 | −900 | −725 | −4 |
| 8 | 1.6 | −900 | −740 | 0 | 1.6 | −890 | −730 | −2 |
| 9 | 1.7 | −920 | −750 | 0 | 1.7 | −880 | −720 | −3 |

As is obvious from the results of Examples 1 to 9, electrophotographic photoreceptors having high sensitivity, excellent durability to repeated use and excellent property of forming uniform images were obtained by using the polymers of the invention as the resin binder for the charge-generating layer. In addition, as the charge-generating layer had excellent solvent-resistance, it did not dissolve out in formation of the charge-transporting layer on the charge-generating layer by the solvent-coating method. Accordingly, the electrophotographic characteristic of the photoreceptors formed in Examples 1 to 9 was excellent and the photoreceptors were used to give sufficient images with no image failure.

EXAMPLE 10 AND COMPARATIVE EXAMPLES 3 TO 5

10 parts of a polymer having the following structural formula (V) (molecular weight, 100,000was dissolved in 90 parts of cyclohexanone and coated on an electroconductive support (having aluminium-plated film on a 75 μm polyethylene terephthalate film support) and dried to form a subbing layer having a thickness of about 0.4 μm on the support.

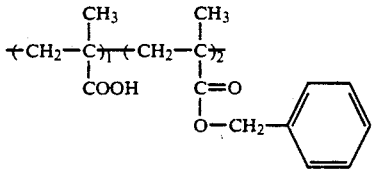 (V)

Next, 2 parts of a trisazo pigment having the structural formula (III) used in Example 1 and 2 parts of a polyester resin (Vylon 200, trade name by TOYOBO CO., LTD.) were added to 7 parts of tetrahydrofuran and dispersed for 12 hours with a ball mill. The thus obtained dispersion was ccated over the previously prepared subbing layer with a wire-round rod and dried to form a charge-generating layer having a thickness of about 0.5 μm thereon.

Next, a solution formed by dissolving 3.6 parts of p-(diphenylamino)benzaldehyde-N'-methyl-N'-phenylhydrazone and 4 parts of polycarbonate of bisphenol A (Panlite K-1300, trade name by TEIJIN LTD.) in a solution comprising 13.3 parts of dichloromethane and 26.6 parts of dichloroethane was coated over the said charge-generating layer with an applicator to form a charge-transporting layer having a thickness of 17 μm thereon. Thus an electrophotographic photoreceptor having a photo-sensitive layer composed of two layers was formed.

For comparison, solutions having the compositions mentioned below were used to form a 0.5 μm subbing layer, in place of the subbing layer of Example 10, and Comparative photoreceptors were prepared in the same manner as in Example 10 ) Comparative Examples 3 and 4).

| | |
|---|---|
| Comparative Example 3: | |
| Alcohol-soluble nylon (CM-8000, trade name by TORAY INDUSTRIES, INC.) | 10 parts |
| Methanol | 110 parts |
| Butanol | 55 parts |
| Comparative Example 4: | |
| Polyvinyl butyral (S-lec BL-1, trade name by Sekisui Kagaku Co., Ltd.) | 10 parts |
| Methanol | 130 parts |
| Butanol | 40 parts |
| Comparative Example 5: | |
| No subbing layer | |
| Comparative Example 6: | |
| Acid casein (ALACID, product of New Zealand) | 45.0 parts |
| Water | 1164.0 parts |
| Methanol | 370.0 parts |
| 28% Aqueous ammonia | 4.5 parts |
| Comparative Example 7: | |
| Polyvinyl alcohol (GOHSENOL, trade name by Nippon Gosei K.K.) | 3.0 parts |
| Water | 97.0 parts |
| Comparative Example 8: | |
| Styrene/Maleinic anhydride Copolymer (SMA-3000, trade name by ARCO Chemical Co.) | 3.0 parts |
| Methyl ethyl ketone | 97.0 parts |

The resin binders used in Comparative Examples 6, 7 and 8 are disclosed in U.S. Pat. No. 4,500,622.

The electrophotographic characteristic of each of the thus prepared photoreceptors was evaluated, using an electrostatic copying paper test apparatus (SP-428 Type, manufactured by Kawaguchi Electric Manufacturing Co.). The measurement was effected in accordance with the static system. Precisely, the photoreceptor to be tested was charged by corona discharge (−5 KV) and the initial surface potential ($V_s$) was determined. Then this was allowed to stand in the dark for 30 seconds, and the surface potential ($V_0$) was determined. Next, the photoreceptor was exposed to a tungusten lamp whereupon the illuminance on the surface of the photoreceptor was 3 lux, and the exposure amount (E50) required for attenuating the surface potential to the half of the initial surface potential ($V_0$) and the surface potential (residual potential $V_R$) in 30 seconds after exposure were determined. The determination was repeated 3000 times. The results obtained are shown in Table 4 below.

TABLE 4

| | 1st Measurement | | | | 3000th Measurement | | | |
|---|---|---|---|---|---|---|---|---|
| | $E_{50}$ | $V_S$ | $V_O$ | $V_R$ | $E_{50}$ | $V_S$ | $V_O$ | $V_R$ |
| Example 10 | 1.5 | −850 | −850 | −1 | 1.5 | −840 | −800 | −10 |
| Comparative Example 3 | 1.7 | −805 | −764 | −15 | 1.8 | −780 | −720 | −200 |
| Comparative Example 4 | 1.8 | −790 | −760 | −20 | 2.0 | −520 | −450 | −220 |
| Comparative Example 5 | 1.5 | −750 | −686 | 0 | 1.5 | −700 | −622 | −5 |
| Comparative Example 6 | 1.7 | −820 | −740 | −5 | 2.0 | −805 | −700 | −120 |
| Comparative Example 7 | 1.8 | −770 | −580 | −1 | 1.8 | −410 | −300 | −10 |
| Comparative Example 8 | 1.6 | −800 | −690 | −1 | 1.6 | −610 | −470 | −20 |

The results in Table 4 apparently indicate that the electrophotographic photoreceptor of the invention (Example 10) had excellent charging property, high sensitivity, low residual potential and sufficient stability in repeated use.

Next, each of the photoreceptors was attached to a copying machine (SF-750, trade name by Sharp, Corp.) and the images obtained were evaluated. As a result, the images obtained by the use of the photoreceptor of Example 10 were uniform and were free from black spots, while those obtained by the use of the photoreceptors of Comparative Examples 3 and 8 had noticeable fogs in the white background area.

EXAMPLES 11 TO 18

Two-layer structural electrophotographic photoreceptors were prepared in the same manner as in Example 10, except that the polymers as indicated in Table 5 below were used in forming the subbing layer. Then the values of E50, $V_s$, $V_O$ and $V_R$ of each of thus prepared photoreceptors were also determined in the same manner as in Example 10. The results obtained are shown in Table 6 below. As is obvious therefrom, all the photoreceptors were excellent like that in Example 10.

TABLE 5

| Example No. | Polymer Used (molecular weight) |
|---|---|
| 11 | 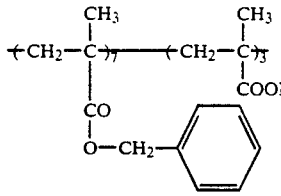 , (120,000) |
| 12 | 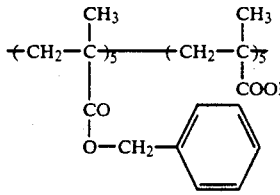 , (150,000) |
| 13 | 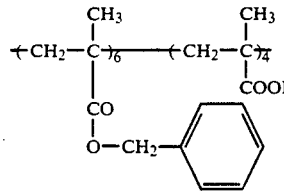 , (100,000) |
| 14 | 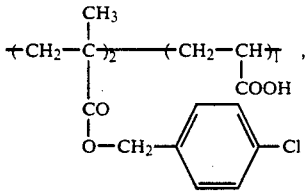 , (95,000) |
| 15 | 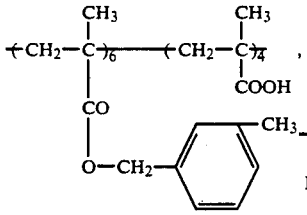 , (100,000) |

TABLE 5-continued

| Example No. | Polymer Used (molecular weight) |
|---|---|
| 16 | 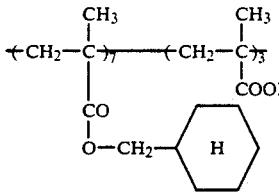 , (150,000) |
| 17 | 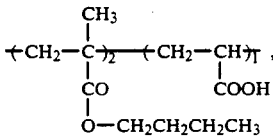 , (100,000) |
| 18 | 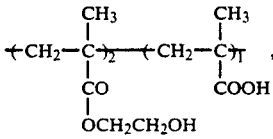 , (120,000) |

TABLE 6

| Example No. | 1st Measurement E50 (lux · sec) | 1st Measurement $V_S$ (V) | 1st Measurement $V_O$ (V) | 1st Measurement $V_R$ (V) | 3000th Measurement E50 (lux · sec) | 3000th Measurement $V_S$ (V) | 3000th Measurement $V_O$ (V) | 3000th Measurement $V_R$ (V) |
|---|---|---|---|---|---|---|---|---|
| 11 | 1.5 | −860 | −813 | −1 | 1.6 | −830 | −803 | −10 |
| 12 | 1.5 | −850 | 805 | −1 | 1.5 | −828 | −790 | −5 |
| 13 | 1.5 | −855 | −811 | −3 | 1.5 | −840 | −801 | −5 |
| 14 | 1.5 | −880 | −840 | −2 | 1.6 | −865 | −820 | −10 |
| 15 | 1.6 | −890 | −846 | −1 | 1.6 | −868 | −835 | −11 |
| 16 | 1.5 | −850 | −800 | −2 | 1.5 | −830 | −795 | −10 |
| 17 | 1.6 | −835 | −793 | −3 | 1.6 | −824 | −789 | −6 |
| 18 | 1.6 | −855 | −806 | −2 | 1.6 | −837 | −785 | −10 |

EXAMPLE 19

Using the coating compositions for photosensitive layers as prepared in Example 10, the charge-transporting layer and the charge-generating layer were formed on the subbing layer formed in the order on the electroconductive support by the method of Example 10. Thus the photo-sensitive layers were formed on the support.

The photoreceptor prepared was charged by corona discharge (+5KV), and the values of E50, $V_S$, $V_O$ and $V_R$ were determined in the same manner as in Example, 10. The results obtained are shown in Table 7. As is obvious therefrom, the photoreceptor prepared in Example 19 was excellent like that prepared in Example 10.

TABLE 7

| Example No. | 1st Measurement E50 (lux · sec) | 1st Measurement $V_S$ (V) | 1st Measurement $V_O$ (V) | 1st Measurement $V_R$ (V) | 3000th Measurement E50 (lux · sec) | 3000th Measurement $V_S$ (V) | 3000th Measurement $V_O$ (V) | 3000th Measurement $V_R$ (V) |
|---|---|---|---|---|---|---|---|---|
| 19 | 1.6 | +820 | +785 | +1 | 1.6 | +800 | +770 | +2 |

EXAMPLE 20

Following the procedure of Example 10, the subbing layer having a film thickness of 0.5 μm was formed on an electroconductive support (formed by vacuum-plating indium oxide on a 100 μ polyethylene terephthalate film, TJ-100, trade name by TEIJIN LTD.).

Next, 1 part of a disazo pigment having the following structural formula (VI), 5 parts of the same hydrazone as that used in Example 10 and 5 parts of a polycarbonate resin (Panlite L-1250, trade name by TEIJIN LTD.) were added to 95 parts of tetrahydrofuran and dispersed with a ball mill for 12 hours. The resulting dispersion ,was coated over the previously formed subbing layer with a wire round rod and dried to form a 10 μphoto-se layer. Thus a photoreceptor having a single-layered photo-sensitive layer was prepared.

The photoreceptor was charged by corona discharge (+5KV), and the values of E50 $V_S$, $V_0$ and $V_R$ were determined in the same manner as in Example 10. The results obtained are shown in Table 8 below. As is obvious therefrom, the photoreceptor prepared in Example 20 was excellent like that prepared in Example 10.

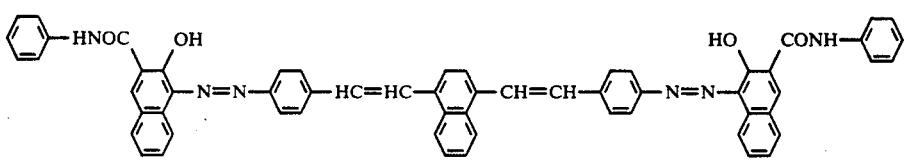

(VI)

TABLE 8

| Example No. | 1st Measurement E50 (lux · sec) | 1st Measurement $V_S$ (V) | 1st Measurement $V_O$ (V) | 1st Measurement $V_R$ (V) | 3000th Measurement E50 (lux · sec) | 3000th Measurement $V_S$ (V) | 3000th Measurement $V_O$ (V) | 3000th Measurement $V_R$ (V) |
|---|---|---|---|---|---|---|---|---|
| 20 | 2.2 | +510 | +480 | +1 | 2.2 | +490 | +465 | +3 |

The results obtained in Examples 10 to 20 demonstrate that incorporation of the polymer of the invention into the subbing layer realized formation of electrophotographic photoreceptors having excellent charging property, high sensitivity, low residual potential, excellent durability to repeated use and excellent capacity of forming uniform images.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising an electroconductive support having thereon at least one charge-generating layer and at least one charge-transporting layer, wherein said charge-generating layer contains, as a resin binder, a copolymer derived from at least one monomer represented by formula (I) and at least one monomer represented by formula (II) and a charge-generating substance, and wherein said charge-transporting layer is formed on said charge-generating layer by a coating solution containing a charge-transporting substance and a solvent not dissolving said resin binder:

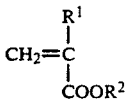

(I)

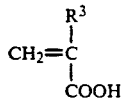

(II)

wherein $R^1$ and $R^3$, which may be the same or different, each represents a hydrogen atom or a methyl group; and $R^2$ represents an unsubstituted or substituted aralkyl group, and wherein the copolymerization ratio by mole of said monomer represented by formula (I) to said monomer represented by formula (II) is 20/1 to 1/20.

2. An electrophotographic photoreceptor as in claim 1, wherein said monomer represented by formula (I) is a benzyl methacrylate and said monomer represented by formula (II) is a methacrylic acid.

3. An electrophotographic photoreceptor comprising an electroconductive support having thereon a photo-sensitive layer, wherein a subbing layer containing a copolymer derived from at least one monomer represented by formula (I) and at least one monomer represented by formula (II) has been provided between said electroconductive support and said photo-sensitive layer:

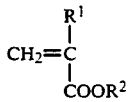

(I)

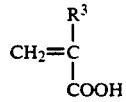

(II)

wherein $R^1$ and $R^2$, which may be the same or different, each represent a hydrogen atom or a methyl group; and $R^2$ represents an unsubstituted or substituted aralkyl group wherein the copolymerization ratio by mole of said monomer represented by formula (I) to said monomer represented by formula (II) is 20/1 to 1/20.

4. An electrophotographic photoreceptor as in claim 1, wherein said charge-transporting layer and said charge-generating layer are laminated on said electroconductive support in the order.

5. An electrophotographic photoreceptor as in claim 1, wherein the weight ratio of said charge-generating substance to said resin binder is 20/1 to 1/10.

6. An electrophotographic photoreceptor as in claim 1, wherein the thickness of said charge-generating layer is 0.01 μm to 4 μm.

7. An electrophotographic photoreceptor as in claim 3, wherein the thickness of said subbing layer is 0.01 μm to 10 μm.

8. An electrophotographic photoreceptor as in claim 1, wherein the coating solvent for said charge-transporting layer is a halogenated hydrocarbon solvent or an aromatic solvent.

9. An electrophotographic photoreceptor as in claim 8, wherein said halogenated hydrocarbons solvent is selected from the group consisting of dichloromethane, chloroform, dichloroethane, trichloroethane, or trichloroethene.

10. An electrophotographic photoreceptor as in claim 8, wherein said aromatic solvent is selected from the group consisting of benzene, toluene, xylene, chlorobenzene, or dichlorobenzene.

11. An electrophotographic photoreceptor as in claim 1, wherein said aralkyl group represented by $R^2$ is an aralkyl group having from 7 to 12 carbon atoms.

12. An electrophotographic photoreceptor as in claim 11, wherein said monomer (I) is benzyl methacrylate and monomer (II) is methacrylic acid.

13. An electrophotographic photoreceptor as in claim 1, wherein the binder resin for use in the charge-generating layer is soluble in an ether solvent or a ketone solvent, but is insoluble or sparingly-soluble in a halogenated hydrocarbon solvent, an aromatic solvent, an ester solvent, or an alcohol solvent, and wherein contains a binder resin which the charge transport layer is soluble in a halogenated hydrocarbon solvent, an aromatic solvent, an ester solvent or an alcohol solvent.

14. An electrophotographic photoreceptor as in claim 1, wherein said monomers of formula (I) and (II) constituting said copolymer comprising said binder resin for said charge-generating layer comprise from 40 to 90 molt% of said copolymer.

15. An electrophotographic photoreceptor as in claim 1, wherein said copolymer comprising said binder resin for said charge-generating layer consists of monomers of formula (I) and (II).

* * * * *